US005439014A

United States Patent [19]

Moussa

[11] Patent Number: 5,439,014

[45] Date of Patent: Aug. 8, 1995

[54] TOOTHBRUSH WITH TOOTHPASTE RESERVOIR

[76] Inventor: Laila B. Moussa, 2255 Van Ness Ave., Suite 201, San Francisco, Calif. 94109

[21] Appl. No.: 144,068

[22] Filed: Oct. 27, 1993

[51] Int. Cl.[6] ..... A46B 11/04

[52] U.S. Cl. ..... 132/311; 401/276; 132/308

[58] Field of Search ..... 132/308, 309, 311; 401/153, 217, 276, 287

[56] References Cited

U.S. PATENT DOCUMENTS

| | | | |
|---|---|---|---|
| 637,522 | 11/1899 | McGinnis . | |
| 637,680 | 11/1899 | Tower . | |
| 1,192,668 | 7/1916 | Miles . | |
| 1,711,183 | 4/1929 | Smith | 132/311 |
| 2,562,937 | 8/1951 | Moricich | 222/104 |
| 2,634,025 | 4/1953 | Hausner | 222/104 |
| 2,652,949 | 9/1953 | Martin | 222/95 |
| 3,653,778 | 4/1972 | Freiling | 401/183 |
| 3,738,762 | 6/1973 | Moore et al. | 401/276 |
| 4,375,924 | 3/1983 | Lemire | 401/287 |
| 4,421,433 | 12/1983 | Villanueva | 401/276 |
| 4,580,588 | 4/1986 | Swope, Jr. | 132/84 B |
| 4,583,563 | 4/1986 | Turner | 132/311 |
| 4,620,528 | 11/1986 | Arraval | 128/62 A |
| 4,622,984 | 11/1986 | Gaebel | 132/308 |
| 5,044,386 | 9/1991 | Nelson | 132/309 |
| 5,062,728 | 11/1991 | Kuo | 401/176 |
| 5,123,765 | 6/1992 | O'Connell | 401/126 |

*Primary Examiner*—John G. Weiss
*Attorney, Agent, or Firm*—Townsend and Townsend Khourie and Crew

[57] ABSTRACT

A toothbrush is provided with a hollow interior cavity adapted to contain liquid dentifrice therein. The toothbrush includes a plurality of minute air apertures for equalizing the air pressure within the cavity and at least one dispensing hole in the bristle region of the toothbrush for dispensing the liquid dentifrice to the bristles. A threaded cap is provided at an open end of a handle of the toothbrush to prevent the dentifrice from escaping from the interior cavity. The cap can be removed to allow the refilling of the interior cavity with the liquid dentifrice.

13 Claims, 2 Drawing Sheets

TOOTHBRUSH WITH TOOTHPASTE RESERVOIR

BACKGROUND OF THE INVENTION

1. Field of the Invention

The present invention relates generally to toothbrushes and more particularly to a toothbrush in which the dentifrice is contained within the toothbrush and is automatically dispensed to the bristles for ease of brushing.

2. Description of the Relevant Art

The concept of brushing one's teeth with a toothbrush in combination with a separate toothpaste substance which is placed on the brush is widely known. However, very few toothbrushes have been developed in which the toothpaste is contained within the toothbrush itself.

There are a few known concepts for providing a toothbrush with a toothpaste reservoir which use a variety of complex internal mechanisms to control the flow of toothpaste from within the toothbrush reservoir. For example, U.S. Pat. No. 637,522 discloses a toothbrush with a hollow handle designed to provide a reservoir for a liquid dentifrice. A valve is used to control the flow of the liquid dentifrice from the handle to the bristles through appropriate apertures. The valve includes a valve stem connected to a screw-cap, which, when manipulated, moves the valve stem to allow liquid to flow through the appropriate apertures.

Existing toothbrushes such as the one above are structurally complex and difficult to manufacture. This has lead to problems in the implementation of the concepts shown in the prior art in developing a usable and low-cost functional product.

SUMMARY OF THE INVENTION

The present invention provides a unique toothbrush for dispensing a liquid dentifrice contained within the brush that is simple to design, easy to manufacture, and can be sold at a reasonable price. The compact, single-molded body of the toothbrush provides a liquid reservoir in which the liquid automatically flows therein to the bristles to allow users to brush their teeth without the normal messy, sticky, or clogging effects inherent in the use of an ordinary toothbrush. The toothbrush is constructed of a rigid, non-bendable material which can withstand the stresses of recurrent use.

According to one aspect of the invention, pin-sized apertures are arranged within the handle of the toothbrush and provide air passages into the liquid reservoir to equalize the pressure therein. This allows the liquid dentifrice to naturally flow automatically within the liquid reservoir to dispensing holes located in the brush region of the toothbrush when the toothbrush is oriented substantially downwardly. There is no need to employ a complex valve mechanism as in the prior art to control the flow of dentifrice within the toothbrush. Also, a steady, constant supply of fresh dentifrice is provided while brushing takes place.

According to a further aspect of the invention, the brush element may be separate from the handle and not formed integral with it. The brush element can be removably attached to the head region of the handle to allow for changing of the brush element upon wear of the bristles after prolonged use.

Other features and advantages of the invention will be apparent in view of the appended figures and following detailed description.

DESCRIPTION OF THE PREFERRED EMBODIMENT

Figure 1:
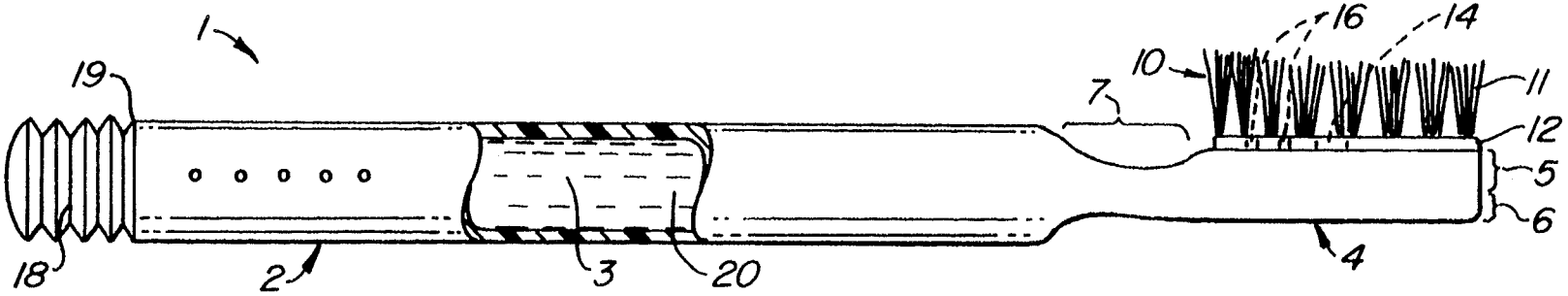
FIG. 1 is a schematic view of a first embodiment of the toothbrush of the present invention in its horizontal configuration.

The preferred embodiment of the invention will now be described with reference to the drawings. FIG. 1 depicts the toothbrush 1 in its generally horizontal configuration. Toothbrush 1 is constructed of a tough, rigid material that is non-bendable. In the configuration of FIG. 1, the liquid dentifrice 20 is contained within the toothbrush 1 and remains within the toothbrush due to the upward orientation of the toothbrush. Toothbrush 1 includes a cylindrical handle 2 having a hollow interior cavity 3 in which the liquid dentifrice 20 is stored. Handle 2 narrows into cylindrical neck region 7, which fluidly connects the interior cavity 3 to the generally flat head region 4. The generally flat head region 4 eases access of the toothbrush 1 into the mouth of a user.

Figure 4:
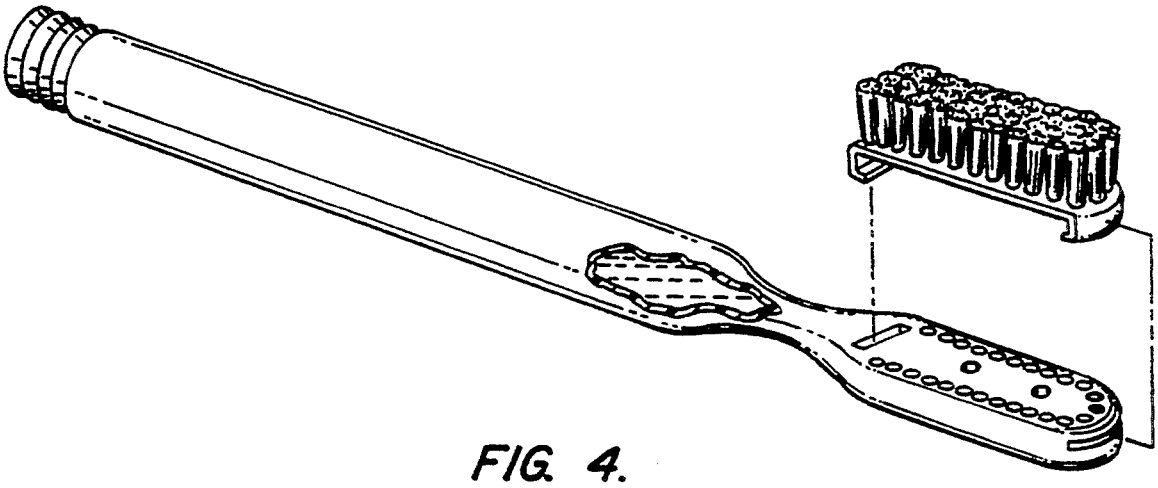
FIG. 4 is a schematic view of an alternative embodiment of the toothbrush in which the brush element is removably attached to the toothbrush head.

In the preferred embodiment, head region 4 contains a plurality of minute air apertures 16 which allow air to enter into interior cavity 3. These apertures may also be interspersed around the periphery of the handle. In addition, a plurality of axially aligned holes 30 may be formed in handle 2 opposite head region 4. The air apertures 16 are arranged to allow air to communicate with the internal cavity 3 so as to equalize the pressure therein. Apertures 16 are sufficiently small to prevent leakage of the liquid contents of cavity 3. The upper portion of head region 4 is made integral with a brush element 10. In an alternative embodiment of the invention as seen in FIG. 4, brush element 10 may be removably attached to the upper portion 5 of the head region.

Brush element 10 includes a number of bristles 11 mounted to the base 12 of the brush element which are used for cleansing the teeth of a user of the toothbrush. Dispensing holes 14 are located in the base 12 and are in fluid communication with the hollow interior cavity 3 extending into the head region 4. Dispensing holes 14 are sized to allow dentifrice to naturally, gradually flow from within the hollow interior cavity 3 to the bristles.

Figure 2:
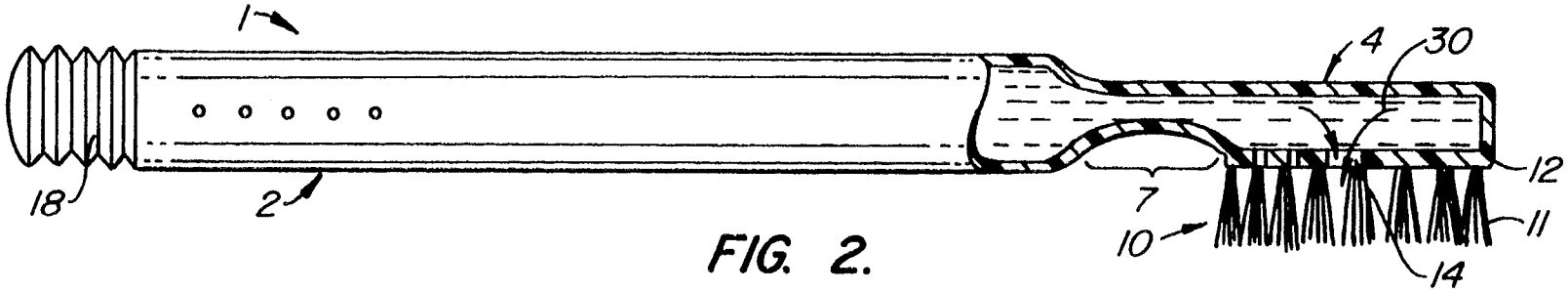
FIG. 2 is a schematic view of the toothbrush in an inverted position showing the liquid dentifrice exiting the toothbrush.
Figure 3:
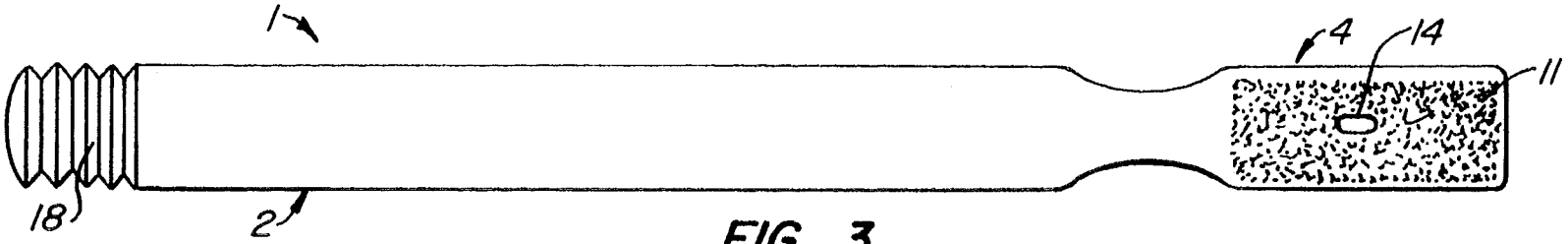
FIG. 3 is a top plan view of the toothbrush.

Handle 2 also includes a threaded cap 18 which can be threaded onto the open end 19 of the handle. In operation, a user removes threaded cap 18 from the open end 19 of the handle 2 and fills the interior cavity 3 with liquid dentifrice. The interior cavity may also be filled with mouthwashes or periodontal solutions such as Paridex, Plax, and saline. Once the interior cavity is substantially filled with the appropriate dentifrice, the cap 18 is threaded onto open end 19 of the handle so as to prevent the dentifrice from exiting the interior cavity 3. As a user brushes his/her teeth, with the toothbrush oriented substantially downwardly as seen in FIG. 2, the liquid dentifrice automatically flows within the interior cavity 3, out through the dispensing holes 14, and to the bristles 11 as per arrows 30 in FIG. 2. In this way, the liquid dentifrice is easily provided into the mouth of the user in a controlled, constant fashion to allow for efficient teeth cleansing. Toothbrush 1 is stored with the hand portion 4 raised so that the liquid dentifrice remains in cavity 3 when the toothbrush is not in use.

Although preferred embodiments of the invention have been described in detail, it is contemplated that modifications of the design of the present invention may be made and that some features may be employed without others, all within the spirit and scope of the invention and the accompanying claims.

What is claimed is:

1. A toothbrush for dispensing a liquid dentifrice contained therein comprising:

a longitudinal handle having a hollow interior cavity adapted to contain the liquid dentifrice, an open end in fluid communication with said hollow cavity, and a generally flat head region fluidly coupled to said interior cavity at an opposite end to said open end, said head region having an upper portion and a lower portion;

a brush element coupled to said upper portion of said head region including a base and a plurality of brush means mounted to said base;

at least one dispensing hole located in said base of said brush element fluidly coupled to said interior cavity for dispensing said dentifrice; and a plurality of pin-sized apertures in said head region of said handle and fluidly coupled to said hollow interior cavity for equalizing the air pressure within the hollow interior cavity without leakage of the liquid dentifrice;

wherein orienting said upper portion of said head region of the toothbrush substantially downwardly causes the liquid dentifrice to automatically flow within said hollow interior cavity, out through said at least one dispensing hole, and to the brush means.

2. A toothbrush as set forth in claim 1 further comprising a threaded cap for threadably engaging said open end of said handle, wherein the liquid dentifrice is poured into the hollow cavity through the open end when the cap is removed and is prevented from flowing out of the cavity by contact with the threaded cap when the cap is threadably engaged to the open end.

3. A toothbrush as set forth in claim 1 wherein said handle further includes a body region and a narrow neck region proximate said head region said neck region connecting said head region to said body region, said neck region being fluidly coupled to said hollow cavity.

4. A toothbrush as set forth in claim 1 wherein said brush element is removably attached to said upper portion of said head region.

5. A toothbrush as set forth in claim 1 wherein said brush means includes a plurality of bristles.

6. A toothbrush as set forth in claim 1 wherein said handle is constructed of a tough, rigid material that is non-bendable.

7. A toothbrush as set forth in claim 1 wherein said liquid dentifrice is a periodontal solution selected from the group consisting of paridex, plax, and saline.

8. A toothbrush as set forth in claim 1 wherein said handle is cylindrical.

9. A toothbrush as set forth in claim 3 wherein said neck region is cylindrical.

10. A toothbrush as set forth in claim 1 wherein said pin-sized apertures are located in spaced-apart positions in the head region of said handle.

11. A toothbrush as claimed in claim 10 wherein said brush element is removably attached to said upper portion of said head region.

12. A toothbrush as set forth in claim 1 further including a plurality of small holes located in the handle proximate the open end of said handle for facilitating the flow of the liquid dentifrice through said handle.

13. A toothbrush for dispensing a liquid dentifrice and having a lateral axis comprising:

a cylindrical handle approximately centered on the lateral axis having a hollow interior cavity;

a generally flat head region integral with said handle and fluidly coupled to said hollow interior cavity, said head region having an upper portion and including a plurality of pin-sized apertures in fluid communication with said cavity;

a narrow neck region forming part of the handle and fluidly connecting said head region to a remaining part of the handle; and a brush element integral with said upper portion of said head region including a base, a plurality of bristles dispersed throughout the base, and at least one dispensing hole located in the base in fluid communication with said hollow cavity, wherein upon rotating the toothbrush about said lateral axis so that said upper portion of said head region is oriented substantially downwardly, the dentifrice within the cavity automatically flows from within the cavity, through the dispensing hole, and out to the bristles of the brush element.

* * * * *